US005122937A

United States Patent [19]

Stoudemire

[11] Patent Number: 5,122,937

[45] Date of Patent: Jun. 16, 1992

[54] REMOTE CONTROL HOLDER AND ILLUMINATOR

[76] Inventor: Thomas L. Stoudemire, 24541 Oneida, Oak Park, Mich. 48237

[21] Appl. No.: 796,463

[22] Filed: Nov. 22, 1991

[51] Int. Cl.[5] ..... F21V 33/00

[52] U.S. Cl. ..... 362/109; 362/157; 362/253

[58] Field of Search ..... 362/23, 85, 109, 157, 362/253, 285, 418, 419

[56] References Cited

U.S. PATENT DOCUMENTS

| | | | |
|---|---|---|---|
| 1,961,474 | 6/1934 | Baum . | |
| 2,016,310 | 10/1935 | Baum . | |
| 2,679,575 | 5/1954 | Haberstump . | |
| 2,688,971 | 9/1954 | Daniels et al. . | |
| 2,779,865 | 1/1957 | Hermeyer et al. . | |
| 2,937,263 | 5/1960 | Lehberger . | |
| 3,092,335 | 6/1963 | Wilson . | |
| 3,297,862 | 1/1967 | Levy et al. . | |
| 4,319,309 | 3/1982 | Benoit . | |
| 4,432,042 | 2/1984 | Zeller . | |
| 4,462,064 | 7/1987 | Schweitzer . | |
| 4,544,990 | 10/1985 | Wieselman et al. . | |
| 4,598,340 | 7/1986 | Dwosh et al. . | |
| 4,772,986 | 9/1988 | McNemor . | |
| 4,831,500 | 5/1989 | McNemor . | |
| 4,893,222 | 1/1990 | Mintzer | 362/157 |
| 4,905,127 | 2/1990 | Kaminski . | |
| 5,010,462 | 4/1991 | Mintzer | 362/109 |
| 5,055,977 | 10/1991 | Acouanetta | 362/109 |

*Primary Examiner*—Richard R. Cole
*Attorney, Agent, or Firm*—Peter D. Keefe

[57] ABSTRACT

A self-contained remote control illumination device which provides selective control over placement of its light source relative to the key pad of the remote control while also providing a base on which to place the remote control. The device is composed of a wedge shaped base having a surface for having placed thereupon a remote control and an illumination system connected with the base. The illumination system includes a battery holder, at least one momentary switch, a light source, a flexible neck for connecting the light source to an end of the base, and associated circuitry. The location of the light source is adjustable by flexing of the flexible neck so that it is appropriately positioned relative to the key pad of the remote control so as to well illuminate it without substantially illuminating areas other than the key pad. Whenever it is wished to actuate the light source, the user presses the momentary switch.

5 Claims, 1 Drawing Sheet

REMOTE CONTROL HOLDER AND ILLUMINATOR

BACKGROUND OF THE INVENTION

1. Field of the Invention

The present invention relates to self-contained illumination devices, and more particularly to an illumination device for the key board of a remote control which further serves as a base for the remote control.

2. Description of the Prior Art

Remote controls have become increasingly popular in recent years for controlling the function of various electronic devices such as televisions, video cassette recorders and stereo equipment. These remote controls include a key pad, the selective pressing of keys on the key pad resulting in a corresponding function being carried out in the electronic equipment with which the remote control communicates.

A problem has arisen in that much of the use of these remote control devices occurs in low light or no light environments. As such, the user of the remote control must frequently fumble with the key pad because it is not possible to clearly identify visually which key is which. This results in very undesirable consequences, such as a television being accidentally turned off when the user instead wanted to change a channel. What is clearly needed is an illumination device which can overcome this annoying aspect of remote control operation of electronic equipment.

In the prior art it is well known how to construct self-contained illumination devices. The most typical device of this kind is the common flashlight, having a case, batteries, a lamp with reflector and an on-off switch. However, such a device cannot be used to solve the above identified problem because of a flashlight's bulk and inability to be attached to the remote control.

Several U.S. patents offer interesting examples of illumination devices which solve particular illumination problems. U.S. Pat. No. 2,688,971 to Daniels et al discloses a lighted hairbrush in which the illumination device is integral with the brush. U.S. Pat. No. 2,779,865 to Hermeyer et al discloses a portable and detachable lighting device for clipboards. U.S. Pat. No. 4,319,309 to Benoit discloses a safety light which is worn by a person when outdoors at night via a belt attachment system. U.S. Pat. No. 4,432,042 to Zeller discloses an illumination device for books which is removably attachable to a book. U.S. Pat. No. 4,462,064 to Schweitzer discloses a head-strap lighting instrument. Finally, U.S. Pat. No. 4,598,340 to Dwosh et al discloses a book light which features a shielded lamp and automatic shut-off when the lamp meets a secondary surface. None of these devices solves the unique problem associated with selectively illuminating the key pad of a remote control.

Most recently, U.S. Pat. No. 4,905,127 to Kaminski, dated Feb. 27, 1990, discloses a remote control illuminator which features a slim design with a self-contained illumination system. The device releasably attaches to the remote control via an elastic band. However, this device does not provide selective control over placement of its light source relative to the key pad of the remote control, nor does it provide a base on which to place the remote control.

Accordingly, what is need in the art is a remote control illumination device which provides selective control over placement of its light source relative to the key pad of the remote control, and provides a base on which to place the remote control.

SUMMARY OF THE INVENTION

The present invention is a self-contained remote control illumination device which provides selective control over placement of its light source relative to the key pad of the remote control, and provides a base on which to place the remote control.

The present invention is composed of a wedge shaped base having a surface for having placed thereupon a remote control and an illumination system connected with the base. The illumination system includes a battery holder, at least one momentary switch, a light source, a flexible neck for connecting the light source to an end of the base, and associated circuitry.

In operation, the user would place a remote control onto the surface of the base, then adjust the location of the light source via flexing of the flexible neck so that it is appropriately positioned relative to the key pad of the remote control so as to well illuminate it without substantially illuminating areas other than the key pad. Whenever it is wished to actuate the light source, the user presses the momentary switch.

Accordingly, it is an object of the present invention to provide a lightweight, inexpensive, self-contained, and selectively actuatable illumination device for conventional remote controls.

It is a further object of the present invention to provide a wedge shaped base for conveniently holding a remote control.

It is another object of the present invention to provide an illumination device for a remote control which features a light source which is selectably positionable relative to the key pad of the remote control so as to minimize illuminating areas other than the key pad.

It is still another object of the present invention to provide an illumination device for a remote control which features, in combination, a base for holding the remote control and an illumination system for selectively illuminating the key pad of the remote control.

These, and additional objects, advantages, features and benefits of the present invention will become apparent from the following specification.

DETAILED DESCRIPTION OF THE PREFERRED EMBODIMENTS

Figure 1:
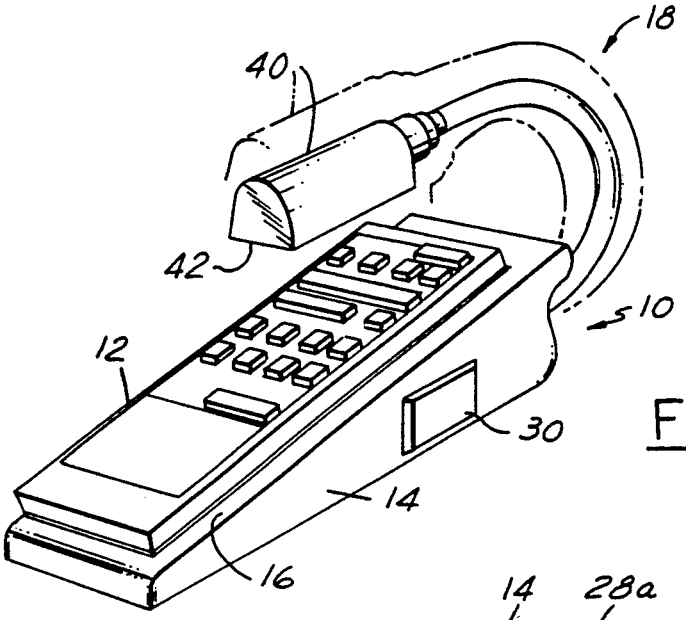
FIG. 1 is a perspective view of the remote control illumination device according to the present invention, shown in operation with respect to a remote control.
Figure 2:
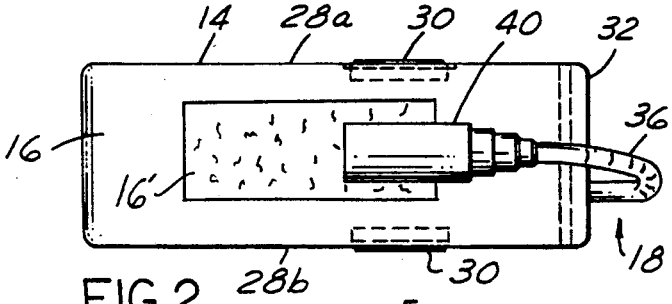
FIG. 2 is a top plan view of the remote control illumination device according to the present invention.
Figure 4:
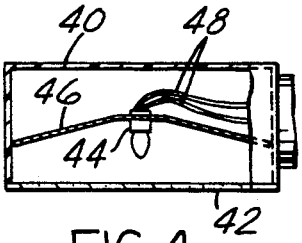
FIG. 4 is a partly sectional side view of the present invention showing the illumination components.
Figure 3:
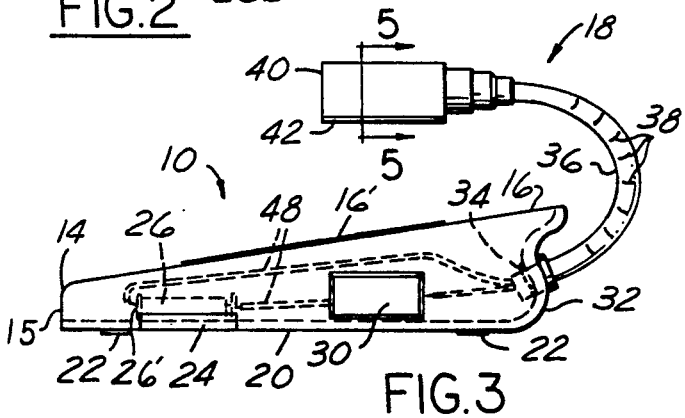
FIG. 3 is a side view of the remote control illumination device according to the present invention, showing internal components in phantom.
Figure 5:
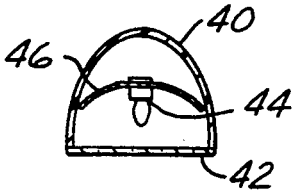
FIG. 5 is a partly sectional end view of the present invention showing the illumination components.
Figure 6:
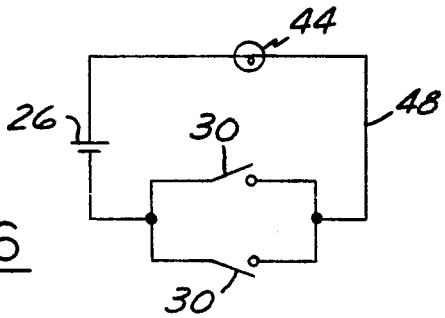
FIG. 6 is a schematic diagram of the electrical circuit of the present invention.

Now, referring to the Drawing, FIG. 1 shows the remote control illumination device 10 according to the present invention in operation with respect to a remote control 12. The remote control illumination device 10 is composed of a wedge shaped base 14 having a surface 16 for having placed thereupon the remote control 12 and an illumination system 18 connected with the base 14.

The base 14 is preferred to be shaped like a wedge and the area provided by the surface 16 is sufficient to accommodate remote controls in common use. It is preferred for the base 14 to have a wedge shape in order that the surface 16 upon which rests the remote control be angled for convenient viewing and operation, such as on the order of about 5 to 35 degrees with respect to the bottom 20 of the base as measured at the front end 15 of the base. The surface 16 is preferred to have attached one portion of a hook and loop fastener 16' (such as the trademark product VELCRO) which interfaces with the other portion of the hook and loop fastener (not shown) located on the bottom of the remote control. The hook and loop fastener permits releasable holding of the remote control 12 on the surface 16 and prevents its slipping off whenever the remote control illumination device is transported. The base 14 is further preferred to be constructed of a light, strong plastic material. The bottom 20 of the base 14 may or may not be provided with padded feet 22.

The illumination system 18 will now be described.

The bottom 20 of the base 14 includes an access door 24 for purposes of servicing one or more batteries 26 internally located within the base 14 via mounting member 26'. It is preferred for each side **28*a*, 28*b* of the remote control illumination device to be provided with an electrical switch 30, preferably of the momentary on type. While only one such switch 30 is required, two are preferred in that the user may be either left or right handed and therefore favor pressing one side 28*a* or 28*b* of the remote control illumination device 10**.

The rear end 32 of the remote control illumination device 10 has connected thereto, via a threaded nut 34, a flexible neck 36. The flexible neck 36 has a plurality of joints 38 which allow it to be manipulated by a user into a variety of shapes. At the distal end of the flexible neck 36 is connected a light source member 40. The light source member 40 is preferably constructed of an opaque plastic everywhere except for a light transmissible lens 42. Internal to the light source member 40 is an electric light 44 and a reflector 46. While the electric light 44 shown is an incandescent electric light, it is possible to construct the electric light from other electric light devices, such as fluorescent or light emitting diode devices. While the reflector 42 is not required, it is preferred for maximizing light output. Further, the light transmissible lens 42 may take any suitable form and is located on the light source member so as to direct light from the electric light directly toward the surface 16. Electrical wires 48 connect the batteries 26, the switches 30 and the electric light 44.

In operation, the user places a remote control onto the surface of the base and thereafter adjusts, via the flexible neck, the location of the light source member so that the light transmissible lens is located generally near and in alignment with the key pad of the remote control. Whenever the keys of the key pad of the remote control need to be pressed in dimly lit environments, the user presses any one of the momentary switches to effect illumination of the key pad without an undue amount of light spilling onto other areas.

To those skilled in the art to which this invention appertains, the above described preferred embodiments may be subject to change or modification. Such change or modifications can be carried out without departing from the scope of the invention, which is intended to be limited only by the scope of the appended claims.

What is claimed is:

1. A remote control holder and illuminator for a remote control, the remote control having a key pad, said remote control holder and illuminator comprising:

a base, said base having a wedge shape, said base having a surface for placing thereupon the remote control; said base further having a front end, a rear end and a bottom, said wedge shape of said base defining a predetermined angle of orientation of said surface with respect to said bottom between said front and rear ends;

an illumination system connected with said rear end of said base, said illumination system comprising:

a flexible neck having a first end and a distal second end, said first end of said flexible neck being connected with said rear end of said base; and a light source member connected to said distal second end of said flexible neck member, said light source member comprising:

an electric light; and light transmission means connected with said light source member for controlling emission of light of said electric light with respect to said light source member;

battery means located within said base for providing electrical energy to said electric light; and electrical wire means for selectively providing electrical contact between said battery means and said electric light.

2. The remote control illuminator and holder of claim 1, wherein said electrical wire means comprises at least one momentary electrical switch connected to said base and electrically connected by electrical wires with said battery means and said electric light.

3. The remote control illuminator and holder of claim 2, wherein said base has a left side and a right side, wherein further said electrical wire means comprises two momentary electrical switches, one momentary electrical switch being connected to said right side of said base, the other momentary electrical switch being connected to the right side of said base, said two momentary electrical switches being mutually electrically connected in parallel to said battery means and said electrical light.

4. The remote control illuminator of claim 2, further comprising a two portion hook and loop fastener means for selectively releasably holding the remote control to the surface of the base, one portion of said hook and loop fastener means being connected with said surface of said base, the other portion of said hook and loop fastener means being connected with the remote control.

5. The remote control illuminator of claim 4, wherein said predetermined orientation of said surface is substantially between 5 and 35 degrees with respect to said bottom of said base as measured at said front end of said base.

* * * * *